US012146730B1

(12) United States Patent
Kirsch

(10) Patent No.: US 12,146,730 B1
(45) Date of Patent: Nov. 19, 2024

(54) AUTOMATIC PRIMER FILLER FOR AMMUNITION RELOADING PRIMER TUBES

(71) Applicant: Double-Alpha Academy B.V., Waalwijk (NL)

(72) Inventor: Saul J. Kirsch, Waalwijk (NL)

( * ) Notice: Subject to any disclaimer, the term of this patent is extended or adjusted under 35 U.S.C. 154(b) by 0 days.

(21) Appl. No.: 18/486,677

(22) Filed: Oct. 13, 2023

(51) Int. Cl.
*F42B 33/04* (2006.01)
*F42B 33/00* (2006.01)
*F42B 33/10* (2006.01)

(52) U.S. Cl.
CPC ..... *F42B 33/04* (2013.01); *F42B 33/002* (2013.01); *F42B 33/10* (2013.01)

(58) Field of Classification Search
CPC ..... F42B 33/00; F42B 33/002; F42B 33/02; F42B 33/04; F42B 33/10
USPC ..... 86/32, 36, 37
See application file for complete search history.

(56) References Cited

U.S. PATENT DOCUMENTS 2,387,672 A 10/1945 Mayherry
2,413,047 A 10/1946 Huddleson et al.
2,824,484 A 2/1958 Thompson
3,128,668 A * 4/1964 Dicken ..... F42B 33/002 86/38
3,320,848 A * 5/1967 Ponsness ..... F42B 33/002 86/38
3,602,084 A 8/1971 Corcoran
3,635,325 A 1/1972 Sterling
4,163,410 A 8/1979 Dillon
4,223,588 A * 9/1980 Simpson ..... F42B 33/002 86/45
4,312,438 A 1/1982 Valsvog
4,343,222 A 8/1982 Dillon
4,475,435 A 10/1984 Mantel
(Continued)

FOREIGN PATENT DOCUMENTS

WO WO-2023203372 A1 * 10/2023 ..... F42B 33/002

OTHER PUBLICATIONS

Vibra Prime, Frankford Arsenal, 2020, https://www.frankfordarsenal.com/reloading-tools/priming-and-depriming-tools/primer-tools/vibra-prime/855712.html.

(Continued)

*Primary Examiner* — James S Bergin
(74) *Attorney, Agent, or Firm* — Whitley Legal Group, P.C.; Annmarie W. Whitley

(57) ABSTRACT

An automated filler for ammunition reloading primer tubes includes an upper feed assembly situated on a lower stand assembly. The upper feed assembly includes a base that holds a primer tube, anchors leaf springs, and houses an electromagnet. Leaf springs connect the base to a bowl situated directly above it. The bowl includes a metal plate, a cavity and ramp for receiving primers, features for rejecting improperly oriented primers, an exit that cooperates with a loading subassembly, which includes an exit channel fluidly connected to the bowl exit, a height adjustable lid, interchangeable resilient tubes, interchangeable tube adaptors, and a metal ring. The ring magnetically secures a primer tube to the base, and a resilient tube and tube adaptor connect the exit channel to the primer tube for loading primers with minimal interference. Optionally, a cover and concave receiving lid can partially surround and cooperate with the upper feed assembly.

20 Claims, 11 Drawing Sheets

(56) References Cited

U.S. PATENT DOCUMENTS

| | | | | |
|---|---|---|---|---|
| 4,542,677 | A * | 9/1985 | Lee | F42B 33/04 86/36 |
| 4,573,392 | A | 3/1986 | Mantel | |
| 5,179,243 | A | 1/1993 | Schroeder | |
| 5,198,606 | A | 3/1993 | Storstad et al. | |
| 5,693,905 | A | 12/1997 | Blodget et al. | |
| 7,497,155 | B2 | 3/2009 | Koskela | |
| 7,549,364 | B2 | 6/2009 | Koskela | |
| 7,552,668 | B1 | 6/2009 | Gonzalez | |
| 7,694,618 | B1 | 4/2010 | Lee | |
| 7,806,034 | B1 * | 10/2010 | Lee | F42B 33/04 86/37 |
| 8,661,959 | B2 | 3/2014 | Koskela | |
| 10,619,984 | B2 | 4/2020 | Pruett et al. | |
| 10,718,599 | B1 * | 7/2020 | Kirsch | F42B 33/02 |
| 10,907,946 | B1 * | 2/2021 | Lier | F42B 33/04 |
| 11,085,746 | B2 | 8/2021 | Carter et al. | |
| 11,085,747 | B2 | 8/2021 | Pruett et al. | |
| 11,609,075 | B2 | 3/2023 | Carter et al. | |
| 11,609,076 | B2 | 3/2023 | Pruett et al. | |
| 11,768,064 | B2 * | 9/2023 | Jones | F42B 33/004 86/37 |
| 2002/0121184 | A1 | 9/2002 | Fowler | |

OTHER PUBLICATIONS

Primer Filler, Nov. 1, 2001, https://www.youtube.com/watch?v=OV1GwJwBD3Q&feature=youtu.be.

Camdex automatic primer machine, May 24, 2014, https://www.youtube.com/watch?v=_ NT5w64h_gY&feature=youtu.be.

Dillon primer flip tray, Feb. 1, 2018, https://www.youtube.com/watch?v=odLtJNtM1CI&feature=youtu.be.

2100 Series Pistol Loading Machine, Camdex Automatic Ammunition Systems, http://www.camdexloader.com/2100Pistol.aspx.

* cited by examiner

AUTOMATIC PRIMER FILLER FOR AMMUNITION RELOADING PRIMER TUBES

FIELD OF THE INVENTION

The present invention relates to ammunition reloading and more specifically to a novel and useful automatic primer tube filler.

BACKGROUND OF THE INVENTION

Many professional and amateur shooting competitors and enthusiasts prefer to reload bullets to save money, to improve accuracy, to accommodate specialty ammunition needs, or simply because they enjoy it. Reloading works for most kinds of ammunition, which consists of a cartridge or case, primer, powder, and a bullet. When reloading ammunition, a new primer can be introduced with a dedicated priming tube or with a dedicated station of a reloading press, both of which cooperate with new primers introduced with a standard primer tube.

Standard primer tubes hold 100 primers in sequence. To load the primer tube, primers are either dropped into the top end of the primer tube with an automated primer filler or loaded into the bottom end of the primer tube if picked up manually. Primers must be loaded so that the flat side of the primer faces away from the top end of the primer tube. A removable stopper, pin, or cap sits at the opposite end to prevent the primers from exiting the tube prematurely. Once the tube is loaded with the desired number of primers, it is ready to be attached to the primer tool or to be used to transfer primers to a fixed primer tube that is part of the reloading press. To transfer the primers to a fixed primer tube, the tube is placed over the fixed primer tube and aligned with chamfers. Then, the stopper is removed to allow all of the primers to slide into the fixed primer tube. To dispense primers directly from the moveable primer tube, the tube is placed so that individual primers can be dispensed, and the stopper is removed.

Unfortunately, loading primers into a primer tube is a tedious and time-consuming task. Primers are very small (just 4.4 mm in diameter) and almost impossible to handle by hand, yet it is critical that the primers are loaded correctly, with their Anvil side facing up. In order to facilitate proper loading, several primer filler solutions are commercially available. The simplest solution is to use a flip tray with a serrated surface. The user shakes and slides the tray around to orient all the primers so that they lay anvil-side up. Then, using a lid, the user flips the tray so the primers are oriented anvil-side-down. The anvil-side-down primers can then be manually picked up one-by-one using a pickup tube, which is then flipped over before loaded in a primer tool or reloading machine and eventually pressed into an empty shell case. Unfortunately, shaking the tray and then picking up individual primers remains tedious and slow. Another option is to use a semi-automatic vibrating primer filler after using a flip tray to properly orient the primers. The vibrating primer filler attaches to a flip tray and then, when activated, it vibrates the tray to coax the primers toward an opening that cooperates with the top end of the primer tube. The primers then fall into the tube. Unfortunately, one still must take significant time to shake and flip the tray to orient the primers.

Fully automated primer fillers are also available commercially. In general, such fillers use a vibrating bowl or tray to deliver primers to a ramp. Once the primers are on the ramp, they travel upwards to an output location that cooperates with the top end of a primer tube. If the primers are upside down as they travel along the ramp, they fall off and back into the bowl or tray as they travel over a notched section of the ramp. Unfortunately, currently available automated primer fillers are unreliable, complex, and expensive in part to minimize the dampening impact of a connected primer tube as it fills with primers and thereby changes weight.

Primers often get stuck at the output location, and occasionally upside-down primers make it past the notched section of the ramp and load into the tube incorrectly, which is a costly and time-consuming mistake. When primers are incorrectly oriented in the primer tube, they will be seated the wrong way in the ammunition. Once a primer is seated incorrectly, the entire bullet is lost, or one must spend additional time taking the loaded ammunition apart. In addition to the reliability issues, these commercially available automated systems run on a timer rather than with a counter, and they have an unpredictable output speed.

Because filling a primer tube correctly and efficiently is very useful when reloading ammunition, it would be desirable to provide an automated system that loads a primer tube with greater accuracy. Additionally, it would be desirable to reduce jams when filing the tube and to accommodate many brands and versions of primers and primer tubes. Such a primer tube filler would be a notable advance in the firearm and ammunition arts.

BRIEF SUMMARY OF THE INVENTION

An automated filler for primer tubes that are used when reloading ammunition includes an upper feed assembly, a lower stand assembly, an outer cover partially surrounding the upper feed assembly, and a receiving top that cooperates with the upper feed assembly. The upper feed assembly includes a base, a bowl, a loading subassembly, and a vibration imparting subassembly. The stand assembly includes a stand that supports the upper feed assembly at the proper height for loading primers into a primer tube and a stand base for stability that further includes optional non-slip features.

The upper feed assembly attaches atop the stand preferably at the upper feed assembly base. The base includes several features, preferably integrally connected, to support power components, vibrating components, the optional cover, a plurality of springs, and a primer tube receiver that supports and couples a primer tube with an output adapter and guide that are part of the primer loading subassembly. The leaf springs, which connect at one end to anchors on the base, connect at a second end to the bowl such that the bowl sits directly over the base. Preferably, an electromagnet is housed by or supported by the base and coupled to a power source and controller. Directly above the electromagnet at a spaced distance is a metal disk attached to the bowl. When the electromagnet is powered on, the metal disk and attached bowl vibrate due to the angles at which the leaf springs are anchored and the alternating power, pulsing at about 60-100 Hz, supplying the electromagnet.

The bowl sitting above the base includes a central cavity and bowl floor for receiving primers, an outer wall and a ramp for routing the primers to an exit, and a bowl exit situated at the end of the ramp. The ramp includes features such as notches and a primer reject arm that deflect misoriented primers off of the ramp. A central cone rises from the bowl floor at its center to direct primers falling from above onto the floor and toward the ramp. The central cone also provides a fastening point for the metal disk, which is preferably secured to the underside of the bowl. The bowl exit cooperates with an exit insert and exit lid both of which are components of the primer loading subassembly.

Primer loading subassembly includes one or more interchangeable exit inserts, exit lid, resilient member such as an O-ring, lid fastener, one or more interchangeable output guides, which are springs or other resilient conduits or chutes, one or more interchangeable output adapters, and a magnetic ring. The exit insert fits in and cooperates with the bowl exit such that primers reaching the bowl exit fall into and through the exit insert. The exit lid sits atop the exit insert and is attached to an anchor on the bowl such that it adjustable to accommodate primers of varying height. One end of the output guide fits into the exit or lower end of the exit insert, and the other end of the output guide fits into the output adapter. The output adapter sits on and partially in the primer tube receiver of the base. Output guides and output adaptors come in various sizes and are interchangeable to accommodate large and small primers. A metal ring attaches in a channel formed within the primer tube receiver of the base and cooperates with a primer tube magnetic adapter removably attached to the primer tube such that the metal ring can magnetically hold a primer tube when the automated filler is operational.

When the primer loading subassembly components are selected and installed and the vibration imparting subassembly is activated, primers entering the bowl exit fall into the exit insert, through the output guide, and out the output adapter to land in the primer tube. Because the output guide is a spring or other resilient conduit or chute that allows primers to move from the bowl to the base while eliminating a firm contact between the bowl and base, the changing weight of the primer tube as it fills with primers does not impact the vibration performance of the bowl. Accordingly, the primers fall into the primer tube with little to no interference.

Additional and optional features include a cover that attaches to the base such that it surrounds the base and bowl while still providing access to the area of the base where the primer tube is attached and to the primer loading subassembly components, particularly those that are interchangeable. Optionally, the cover is transparent. A receiving lid can further be placed on the cover. The receiving lid includes a center opening and is shaped to encourage primers poured into it to funnel down through the center opening to the bowl preferably situated directly below it.

Figure 1:
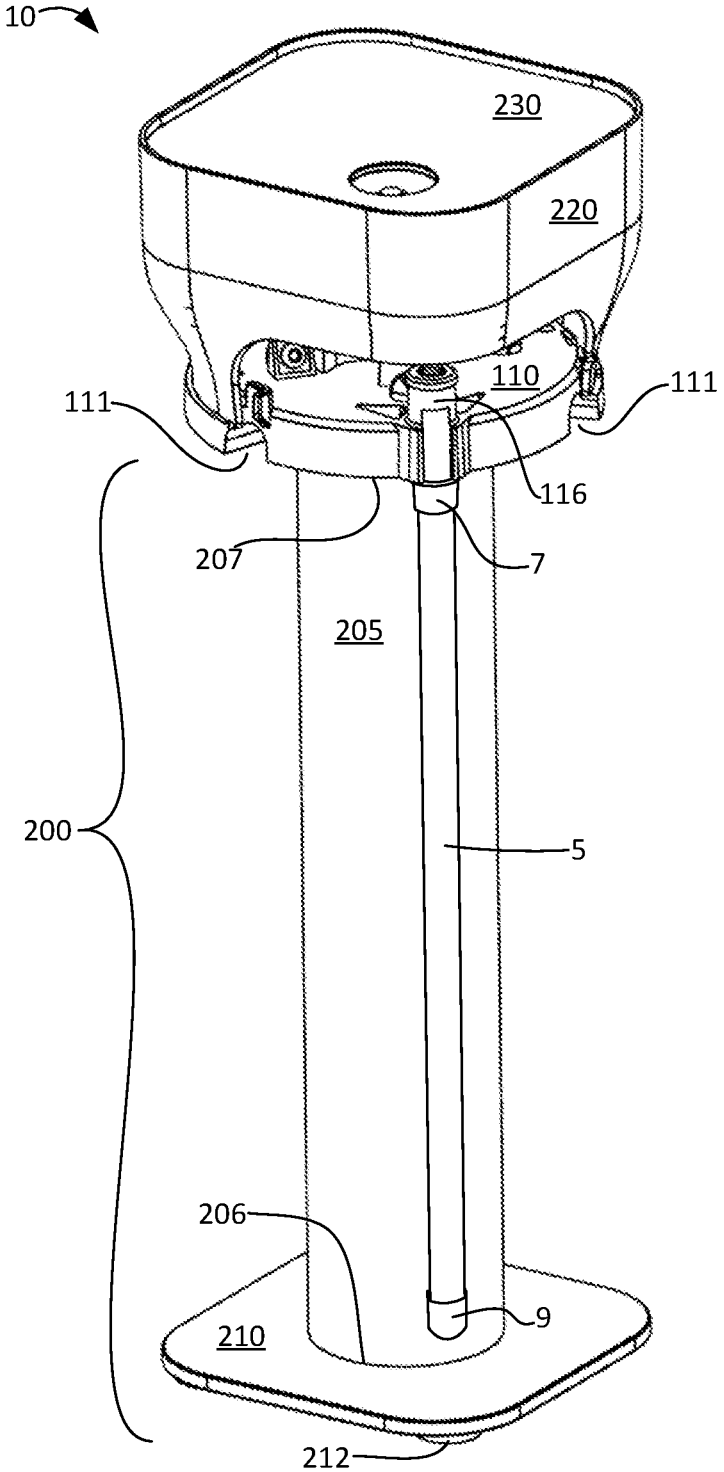
FIG. 1 is a perspective view of the components of a primer tube filler according to a preferred embodiment of the present invention and in cooperation with a primer tube.
Figure 2:
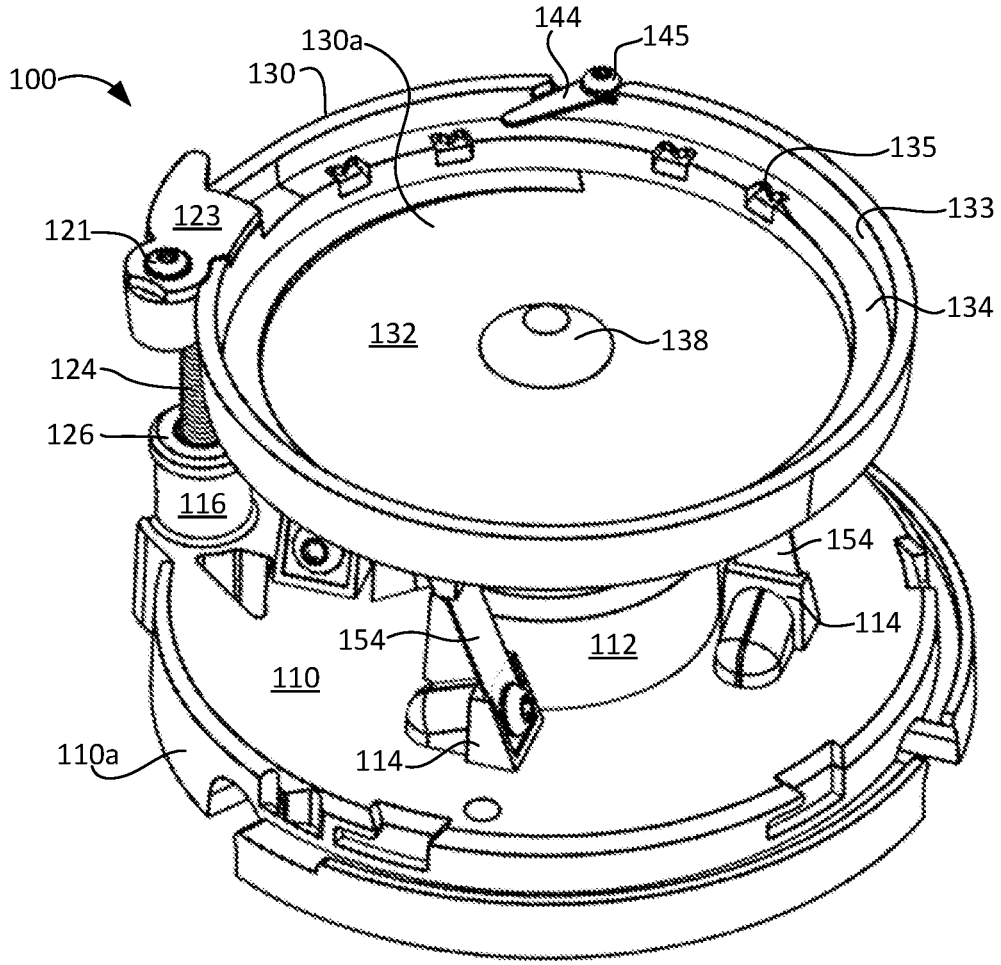
FIG. 2 is a perspective view of the upper filler assembly according to a preferred embodiment of the present invention.
Figure 3:
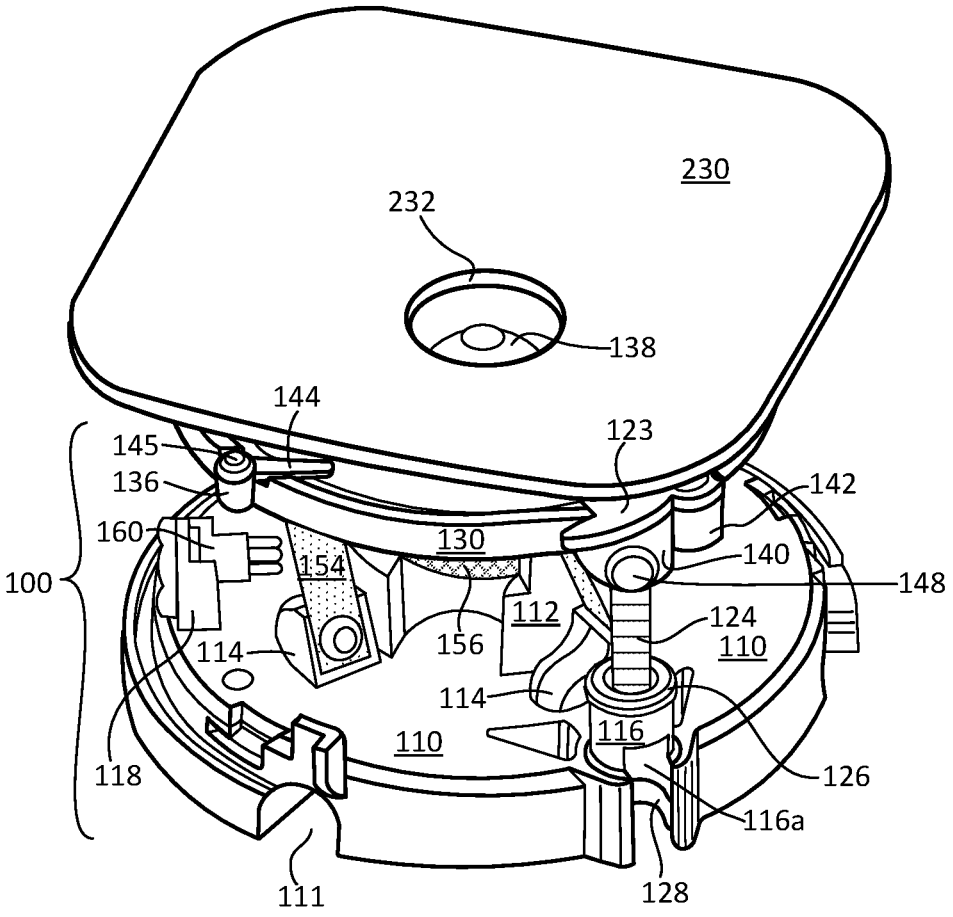
FIG. 3 is a perspective view of the upper feed assembly and receiving top according to the preferred embodiment of the present invention.

For a better understanding of the invention reference is made to the following detailed description of the preferred embodiments of the invention which should be taken in conjunction with the above-described drawings.

DETAILED DESCRIPTION OF THE INVENTION

The present invention, as shown in FIGS. 1-13, relates to a novel and useful automated filler 10 for primer tubes 5, which is useful for reloading ammunition. The automated filler 10 includes an upper feed assembly 100, a lower stand assembly 200, an outer cover 220 partially surrounding the upper feed assembly 100, and a receiving top 230 that cooperates with upper feed assembly 100. Upper feed assembly 100 includes a base 110, a bowl 130, a loading subassembly 120, and a vibration imparting subassembly 150. Stand assembly 200 includes a stand 205 and stand base 210 with optional feet 212.

FIG. 1 illustrates stand 205 and stand base 210 of stand assembly 200. As shown, stand base 210 is a structure sized and oriented to stabilize the filler 10 during operation. Optionally, a non-slip coating is applied to the underside of stand base 210 to provide stability. Alternatively, a plurality of feet 212 are attached to the underside of stand base 210 to provide additional stability. Stand 205 extends upwards from stand base 210 as shown in FIG. 1 and supports upper feed assembly 100. Preferably, a first end 206 of stand 205 is centered on and fixedly attached to stand base 210. Stand 205 can be an extruded metal such as aluminum, a solid metal or other material, or an assembly of several components as long as they work together to elevate upper feed assembly 100 to a height that facilitates upper feed assembly 100 accommodating and supporting primer tube 5 positioned in a vertical position as shown in FIG. 1. Preferably, primer tube 5 is further supported by a primer tube magnetic adapter 7, which is preferably a removable ring housing a magnet that is secured to primer tube 5 with a set screw (not shown). Primer tube magnetic adapter 7 interacts with features of the upper feed assembly 100 as is discussed below. Typically, primer tube 5 additionally includes a endcap 9 secured with a removable pin **9*a* as shown in FIG. 1. In a preferred embodiment and as shown in FIG. 1, stand 205 is a round extrusion with a height of about 32 cm and a diameter of about 6 cm, and stand base 210** is a steel plate with a 12.5 cm square footprint and rounded corners.

As shown in FIG. 1, attached to a second end 207 of stand 205 is upper feed assembly 100. Preferably, upper feed assembly 100 defines a cavity (not shown) for receiving stand 205. More preferably, the cavity is generally centered on and formed within the underside of base 110. When the second end 207 of stand 205 is positioned within the cavity, it can be securely attached with a plurality of set screws accessibly through openings 111 positioned around the perimeter of base 110. Other methods of fixedly attaching the base to the stand can be substituted as will be readily understood by those skilled in the art.

FIGS. 2-13 illustrate several components of upper feed assembly 100, including base 110, bowl 130, loading subassembly 120, and vibration imparting subassembly 150. Base 110, which is shown in detail in FIG. 6, preferably is made of a rigid material such as plastic or metal and is configured as shown with a generally circular perimeter. While a circular perimeter is preferred, base 110 could be any shape as long as base 110 supports the additional components of upper feed assembly 100 and minimizes interference with the primer tube 5 when primer tube 5 is present and receiving primers. In addition to facilitating a secure connection with stand 205, base 110 supports bowl 130, loading subassembly 120, and several components of vibration imparting subassembly 150. Additionally, base 110 supports optional outer cover 220, which in turn supports optional receiving top 230.

Positioned near the center of base 110, a central support 112 preferably extends upward and partially surrounds and supports a vibrator or other vibration component such as an electromagnet 156, which is part of the vibration imparting subassembly 150. Surrounding central support 112 are several anchors 114 that cooperate with a plurality of leaf springs 154, which also are part of the vibration imparting subassembly 150. A primer tube receiver 116 and a power connector support 118 are preferably located near the perimeter 110*a* of base 110. Optionally and preferably, central support 112, anchors 114, primer tube receiver 116, and power connector support 118 are integrally formed such that base 110 is one component. Alternatively, some or all parts are fixedly attached to base 110.

Figure 5:
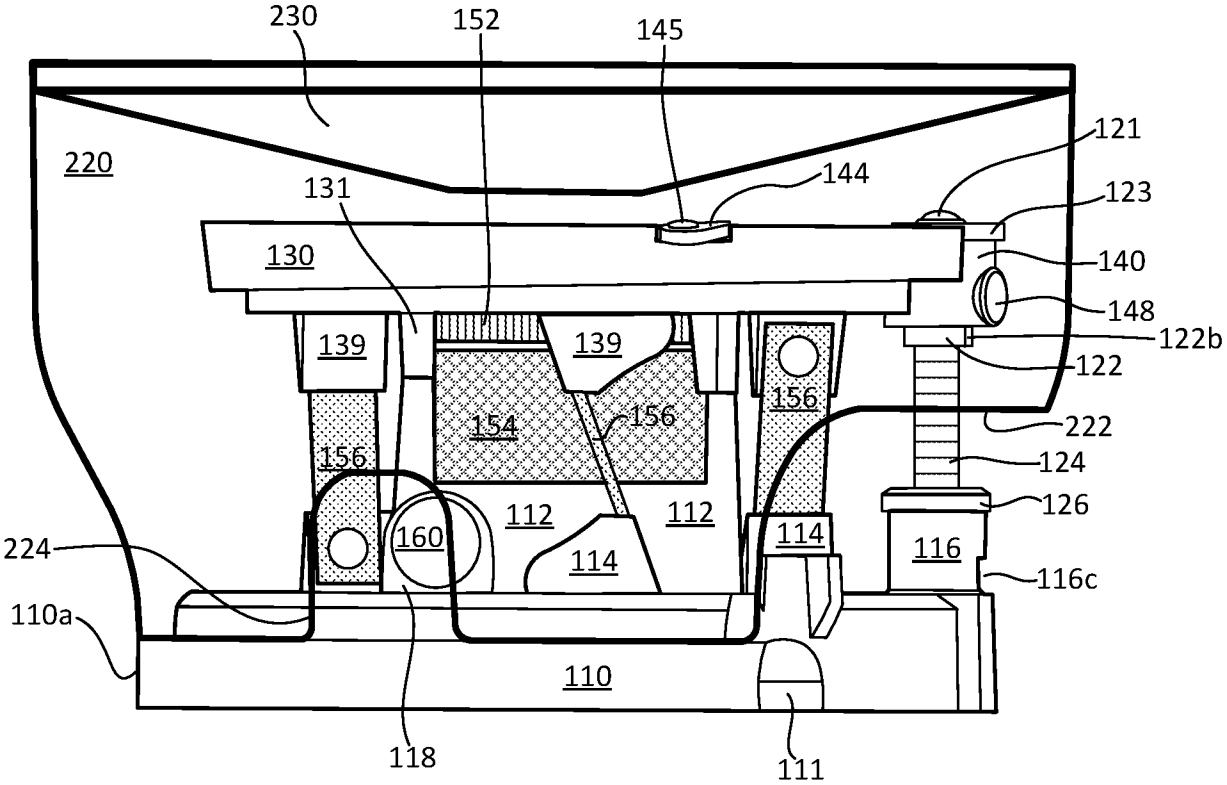
FIG. 5 is a second partially exploded side view of the upper feed assembly, outer cover, and receiving top according to the preferred embodiment of the present invention.
Figure 6:
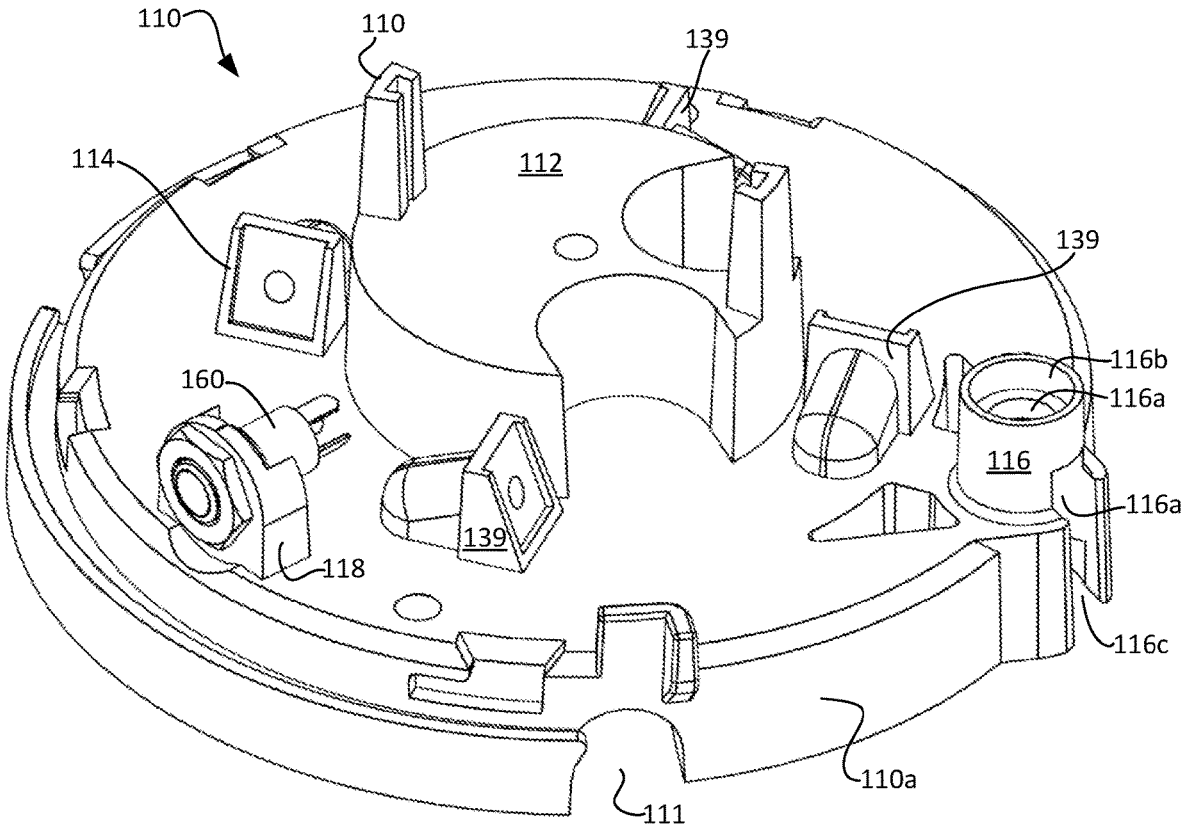
FIG. 6 is a perspective view of the upper feed assembly base according to the preferred embodiment of the present invention.
Figure 7:
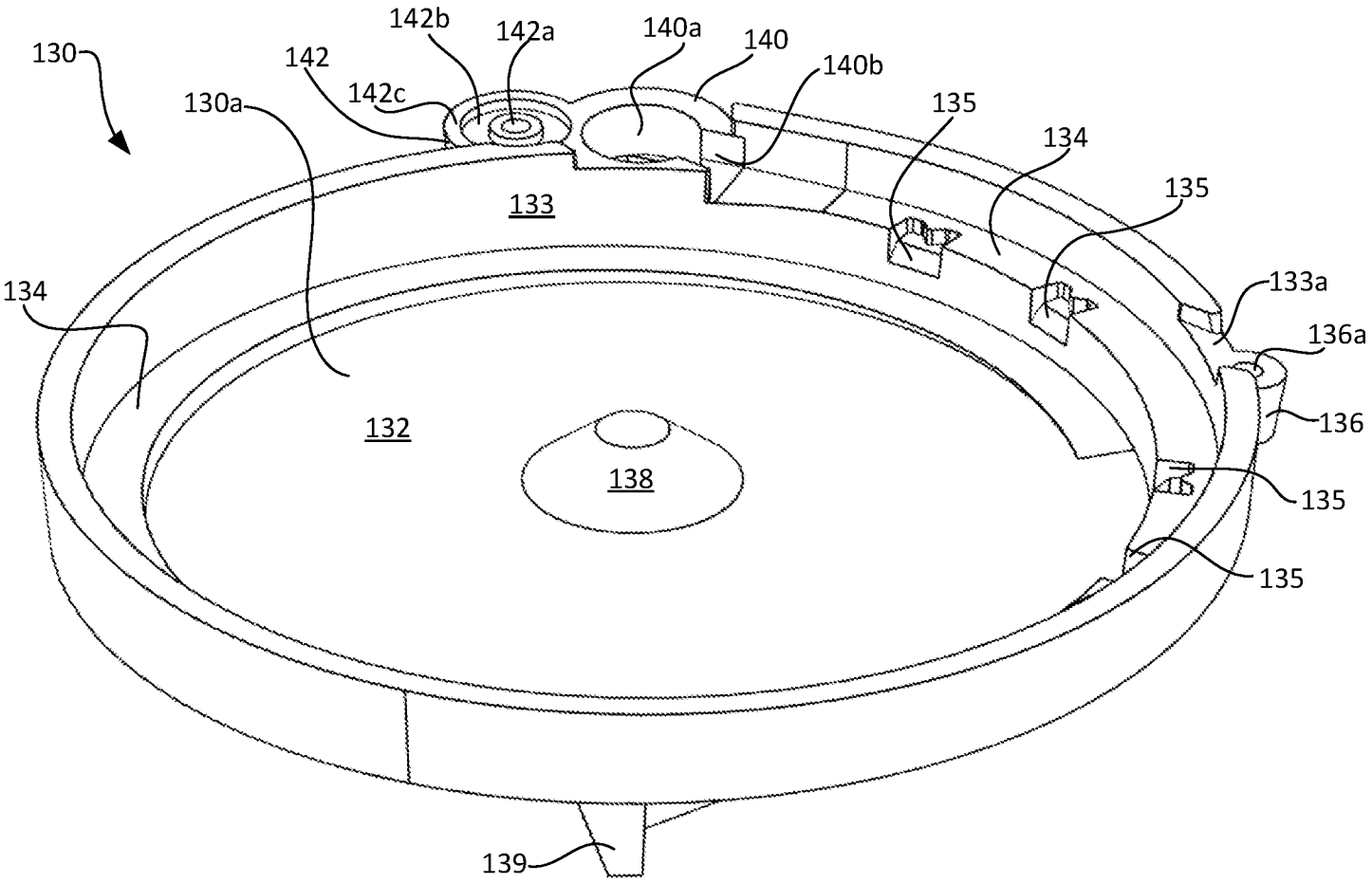
FIG. 7 is a perspective view of the upper feed assembly bowl according to the preferred embodiment of the present invention.
Figure 8:
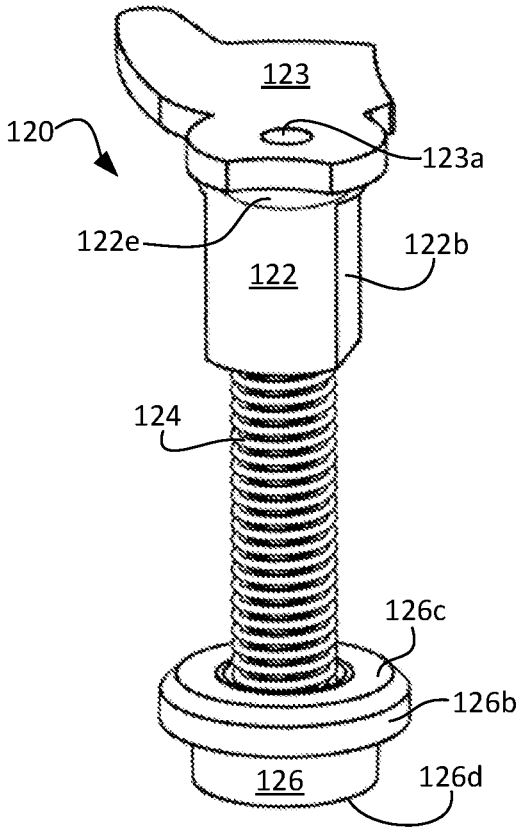
FIG. 8 is a perspective view of the loading subassembly of the upper feed assembly according to the preferred embodiment of the present invention.
Figure 9:
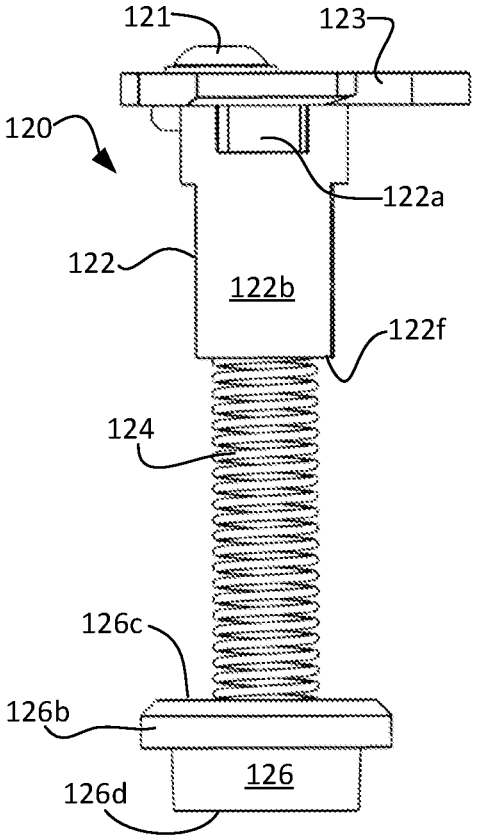
FIG. 9 side view of the loading subassembly of the upper feed assembly according to the preferred embodiment of the present invention.
Figure 10:
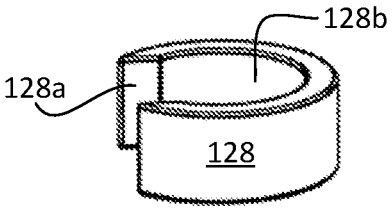
FIG. 10 is a perspective view of the tube support ring according to the preferred embodiment of the present invention.

Primer tube receiver 116 of base 110 is sized and positioned to cooperate with an exit point or channel from bowl 130 when bowl 130 is connected to base 110 and operational. For example and as shown in FIG. 5, a bowl exit 140 sits directly over primer tube receiver 116 of base 110. Primer tube receiver 116 includes a first channel 116*a* sized to accommodate the outer diameter of a primer tube 5 or a primer tube magnetic adapter 7 or other connector (not shown) and a second channel 116*b* sized to accommodate output adaptors 126 of the primer loading subassembly 120. Additionally, a tube slot 116*c* partially exposes first channel 116*a* as shown in FIG. 6. Tube slot 116*c* facilitates placing and adjusting primer tube 5 within primer tube receiver 116. First channel 116*a*, second channel 116*b*, and tube slot 116*c* are all in fluid communication with one another when no primer tube 5 is present.

Vibration subassembly 150 includes any combination of components designed to impart vibrations on a bowl or trough. Preferably, vibration subassembly 150 includes an electromagnet 156, a plurality of leaf springs 154, a power connector 160, and a metal disk 152. Electromagnet 156 preferably has good magnetic conductivity, a flat and clean holding surface, a thickness over 3 mm, and a contact area larger than the holding surface of the magnet. More preferably, electromagnet 156 is a holding type 12V DC solenoid electromagnet with a power of 3.6 W, resistance of 40Ω, and holding force of at least 245 N such as Model H4020 from Landa Solenoid in Zhongshan City, Guangdong Province, China. Additionally, electromagnet 156 preferably rests partially on or in central support 112 of base 110 and further secures to base 110 with a fastener such as a steel socket head screw. For selective operation optionally controlled by a switch, electromagnet 156 couples to a power source, preferably through an electrical connection with power connector 160, which is configured to receive low-voltage DC power provided from a wall mounted AC-DC converter. The vibration subassembly 150 components work together such that the electromagnet is pulsed at about 60-100 Hz, which creates the vibration needed to drive primers up a bowl ramp 134, which is discussed below, as is known to those skilled in the art. Optionally, power connector 160 is press fit into power connector support 118. Power connector 160 is preferably a barrel socket such a 5.5×2.1 mm DC barrel socket that cooperates with electromagnet 156. Optionally and preferably, power connector 160 also couples to a controller 158 that allows the user to adjust the vibration frequency from 60 HZ-100 Hz. Accordingly, the user can optimize the vibration frequency according to what works best for advancing the particular primers filing in bowl 130. Additionally, the user can use controller 158 to activate and adjust an automatic shut-off feature. For example, it can be set from 30 sec up to 4 min. depending on the time a user needs to run the filler to feed through 100 of the user's preferred brand of primers.

Surrounding electromagnet 156 when installed on base 110 at central support 112 are a plurality of leaf springs 154, preferably positioned at a regular spaced distance from one another. Each leaf spring 154 fixedly attaches at a first end 154*a* to base 110 at base anchors 114 with fasteners 170 such as six-lobed, star-patterned button head screws. Each leaf spring 154 fixedly attaches at a second end 154*b* to bowl anchors 139 positioned around the underside of bowl 130. Leaf springs 154 can be any elastic spring or resilient component that is flexible and capable of absorbing vibration. Importantly, leaf springs 154 are angled such that they cause vibrations capable of moving primers up the bowl ramp 134 as will be understood by those skilled in the art. Preferably, leaf springs 154 are angled between 15° and 30° relative a level surface or the horizon. More preferably, leaf springs 154 are angled at 20° relative to a level surface or the horizon. A level surface as used herein should be understood as a surface perpendicular to the force of gravity. Where base 110 is level, leaf springs 154 are similarly oriented relative to vase 110.

Metal disk 152 of vibration subassembly 150 preferably securely attaches to the underside of bowl 130, optionally within guides or extensions 131. More preferably, metal disk 152 attaches to bowl 130 with a steel six-lobed, star-patterned flathead screw (not shown) positioned near the center of metal disk 152 that extends into the underside of a center cone 138 of bowl 130. Metal disk 152 preferably has about a 4 cm diameter and is about 5 cm thick. When installed, metal disk 152 sits above electromagnet 156 at a spaced distance, which is preferably between 0.5 and 0.8 mm. When connected to power and activated, electromagnet 156 pulses at a rate preferably between 60 Hz and 100 Hz causing metal disk 152 to be repeatedly pulled toward electromagnet 156 at the same rate while angled leaf springs force the bowl to rotate slightly with each pull. With each release of the electromagnet, the bowl twists and springs back to its initial position. The electromagnetic pull combined with the twist or rotation of the bowl caused by leaf springs 154 creates the vibratory motion needed to drive the primers up bowl ramp 134.

FIGS. 2-5, 7, and 11-12 illustrate the features of bowl 130. Bowl 130 features a central cavity 130*a* that is defined by the bowl wall 133 that extends around its perimeter and bowl floor 132 that for receiving primers, a bowl exit 140 in fluid communication with the bowl central cavity 130*a*, and a ramp 134 within the bowl cavity 130*a*. Ramp 134 extends along bowl wall 133 and the perimeter of the central cavity 130*a* from a low point at bowl floor 132 to a high point at bowl exit 140. Preferably positioned along ramp 134 are several notches 135 sized and configured to receive and deflect or otherwise encourage any primers traveling along ramp 134 to fall off ramp 134 if their anvil side is facing down such that it is resting on or facing ramp 134. Formed within bowl wall 133 is an optional notch 133*a* and a primer reject anchor 136*a* that accommodate and support a primer reject arm 144 that is secured to primer reject anchor 136*a* with a fastener 145 such as a screw. Optionally, primer reject arm 144 is attached to bowl wall 133 along its edge (not labelled) or is integrally formed with bowl wall. Optionally, its height or orientation relative to ramp 134 can be adjusted. Primer reject arm 144 is positioned such that it deflects primers traveling along ramp 134 that are sitting on their edge, such that neither the flat side or anvil side of the anvil is resting on ramp 134. To minimize the risk of jams caused by misoriented primers, primer reject arm 144 directs unfavorably oriented primers off of ramp 134 so that they fall back onto bowl floor 132.

Positioned at the center of bowl floor 132 is central cone 138, which extends upwards from bowl floor 132. Central cone 138 is configured to encourage primers dropped from above to move away from the center of bowl 132 and toward the outer perimeter of central cavity 130*a*. Central cone 138 also facilitates connection with metal disk 152, which is connected to the underside of bowl 130. Optionally and preferably, extending from the underside of bowl 130 are supports or guides that further facilitate connection of metal disk 152 to bowl 130. Preferably, and as shown in the Figures, bowl 130 physically connects to base 110 only via leaf springs 154.

Figure 11:
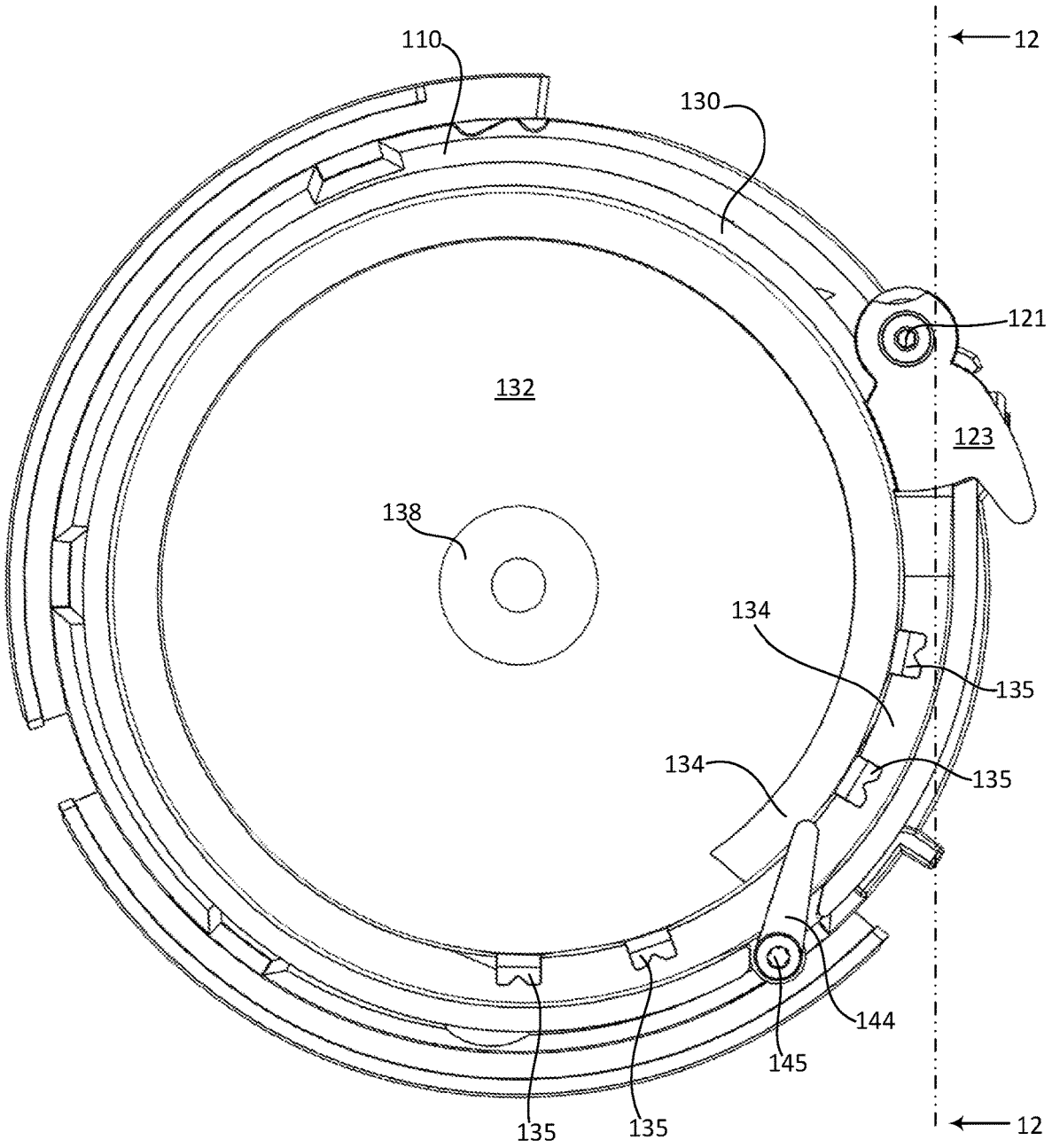
FIG. 11 is a top view of the upper feed assembly according to the preferred embodiment of the present invention.

Bowl exit 140 is positioned at the highest point of ramp 134. Bowl exit 140 defines a channel 140*a* that is configured to house components of the primer loading assembly 120. Adjacent bowl exit 140 is primer loading anchor 142, which defines on an upper surface 142*c* a central bore 142*a* for receiving a fastener 121 and one or more recesses or an annular channel 142*b* for receiving a resilient member 129 such as an O-ring, which is discussed further below. Bowl exit 140 and primer loading anchor 142 are preferably configured to support a height-adjustable exit lid 123 of primer loading subassembly 120. Optionally, exit lid 123 also can pivot between two or more positions, which is useful when swapping components, clearing primer jams, and adjusting clearance within the primer path below. For example, exit lid 123 can pivot between an open position exposing the bowl exit and exit channel of the bowl and a closed position wherein at least part of the lid covers the bowl exit and exit channel of the bowl, which is shown in FIG. 11.

Figure 12:
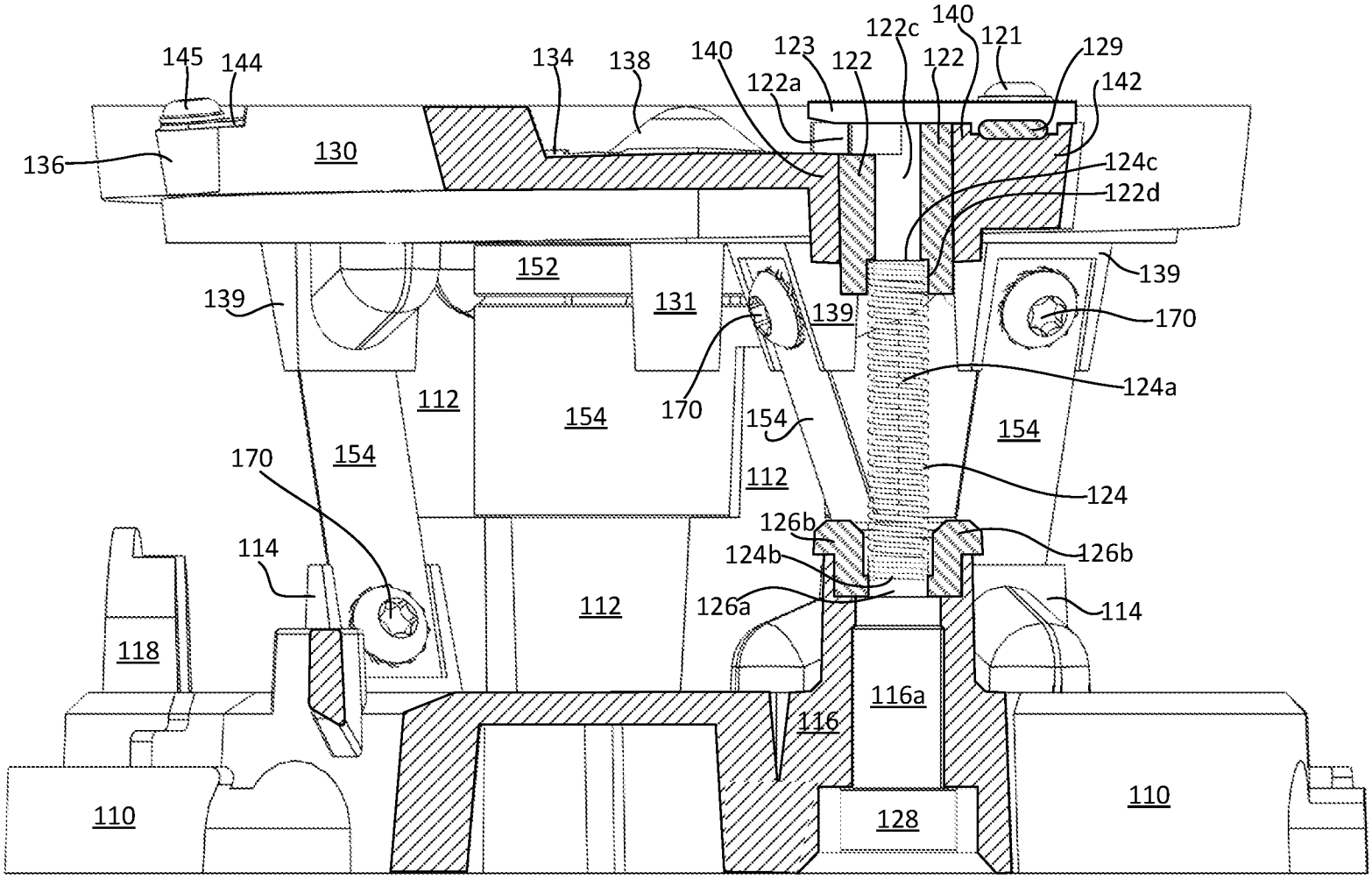
FIG. 12 is a cross section view of the upper feed assembly according to the preferred embodiment of the present invention as cut along the line 12-12 shown in Figure.
Figure 13:
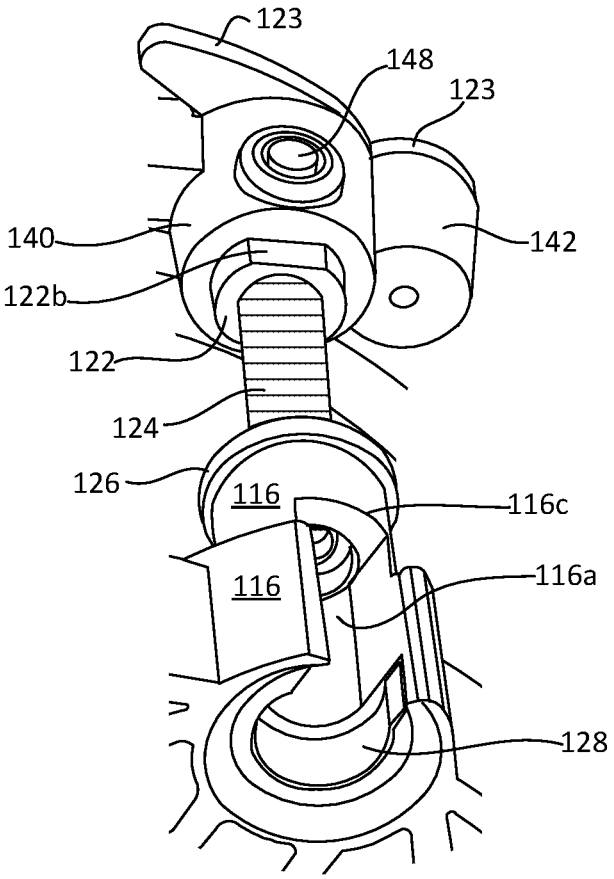
FIG. 13 is a lower perspective view of the loading subassembly as installed on the bowl and base of the upper feed assembly according to the preferred embodiment of the present invention.

Primer loading subassembly 120 includes an interchangeable exit insert 122, exit lid 123, resilient member 129, fastener 121, interchangeable output guide 124, interchangeable output adapter 126, metal ring 128, and optional primer tube magnetic adapter 7, all of which are shown in detail in FIGS. 1, 8-10 and 12-13. Interchangeable exit insert 122 preferably has at least one planar surface 122*b*, an upper end 122*e*, and a lower end 122*f* and defines a channel 122*c* extending from its upper end to its lower end and an opening 122*a* near its upper end. Planar surface 122*b* is configured to cooperate with a fastener 148 such as a set screw that secures exit insert 122 within bowl exit 140 as shown in FIGS. 5 and 13. Exit insert opening 122*a* is in fluid communication with channel 122*c* and is further configured to cooperate with exit ramp 134 of bowl 130 and bowl exit 140 such that primers reaching bowl exit 140, travel into opening 122*a* and then fall into channel 122*c*. At the lower end (not labelled) of exit insert 122, interchangeable output guide 124 attaches, preferably by fitting into an annular notch 122*d*.

Exit lid 123 preferably sits atop interchangeable exit insert 122 and is connected to bowl 130 at primer loading anchor 142 by a fastener 121 that cooperates with central bore 142*a*. Exit lid 123 importantly further prevents primers from accidentally turning onto their sides as they exit bowl ramp 134 and enter the bowl exit 140, which would cause a jam at or in exit insert 122 opening 122*a* or channel 122*c*. Preferably, exit lid 123 is height adjustable such that it can increase or decrease the clearance of opening 122*a* and channel 122*c* of exit insert 122 to accommodate primers of different heights and more preferably large and small primers. Height adjustability of lid 123 is facilitated by resilient member 129, which is shown in FIG. 12, Resilient member 129 is preferably an O-ring positioned in annular channel 142*b* of anchor 142. Resilient as used herein refers to materials and components that recoil or spring back into shape after bending, stretching, or being compressed. By tightening or loosening fastener 121, a user can decrease or increase the height or clearance of bowl exit 140 and opening 122*a* in exit insert 122. While an O-ring is illustrated and described, other resilient materials, seals, and components can be substituted as will be understood by those skilled in the art. For example, a plurality of rubber or silicone inserts can be housed in a plurality of recesses formed on the upper surface 142*c* of anchor 142.

Positioned at a spaced distance below exit insert 122 and preferably fixedly attached to base 110 at primer tube receiver 116*a* is a metal ring 128. Metal ring 128 cooperates with primer tube magnetic adapter 7 to hold the primer tube at or within primer tube receiver 116*a* when the automated filler 10 is operating. Metal ring 128 is preferably made of steel and includes a ring gap 128*a* that is sized and configured to cooperate with the primer tube receiving slot 116*c* when the metal ring 128 is installed therein.

Interchangeable output guide 124 preferably is a spring or other resilient chute or connector defining a channel 124*a* having a diameter slightly larger than the diameter of the primers it will guide. As discussed above, resilient as used herein refers to materials or components that recoil or spring back into shape after bending, stretching, or being compressed. Importantly, output guide 124 facilitates a smooth transfer of the primers from bowl 130 to primer tube 5 without adding any undesirable weight. Output guide 124 eliminates the need for the traditional hard contact between an automated primer filler bowl 130, base 110, and primer tube 5, which negatively impacts the vibration of bowl 130, and thereby the movement of the primers, as primer tube 5 fills with primers and becomes heavier. With the present design, bowl 130 simply floats on leaf springs 154, while output guide 154 accurately transfers primers from bowl 130 to primer tube 5. Because the weight of primer tube 5 is carried by base 110, any additional weight due to the added primers does not change the vibration frequency or pattern of bowl 130. Accordingly, bowl 130 continues to operate without interference, eliminating a crucial flaw of currently available automated primer tube fillers.

At a lower end 124*b*, output guide 124 fits within an upper end 126*c* of interchangeable guide adapter 126. At its upper end 124*c*, output guide 124 fits within exit insert 122. Output adapter 126 includes an annular flange 126*b* at its upper end 126*c* that rests atop primer tube receiver 116 of base 110 and defines a channel 126*a* that extends from its upper end 126*c* to its lower end 126*d*. When output guide 124 is positioned within output adapter 126 and exit insert 122, a continuous channel is formed between opening 122*a* of exit insert 122 and a primer tube 5 positioned in primer tube receiver channel 116*a* via exit insert channel 122*c*, output guide channel 124*a*, and output adapter channel 126*a*.

Figure 4:
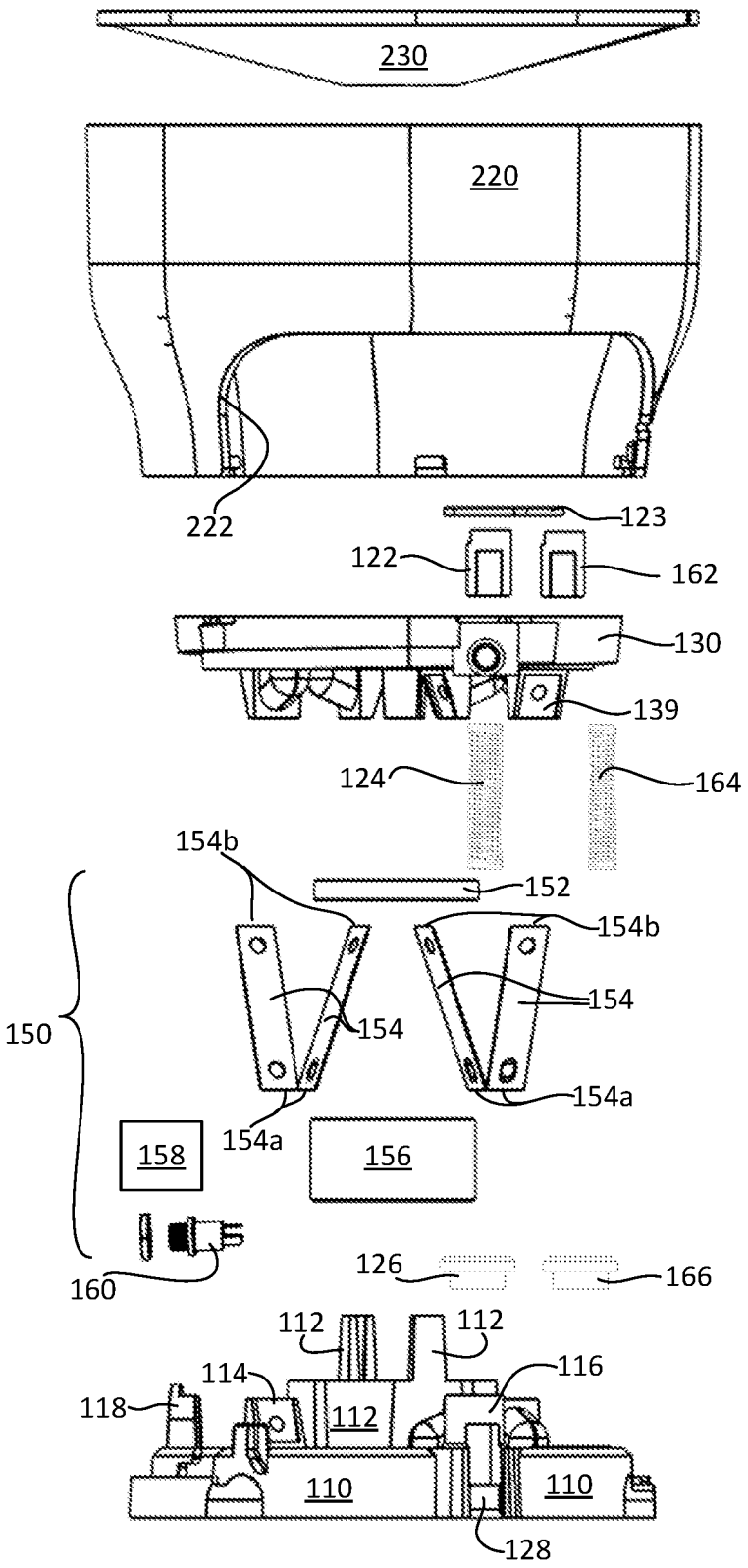
FIG. 4 is a first partially exploded side view of the upper feed assembly, outer cover, and receiving top according to the preferred embodiment of the present invention.

Because primers come in small and large sizes, exit insert 122, output guide 124, and output adapter 126 are preferably interchangeable and identically configured except for small differences in size such that exit inserts 122, output guides 124, and output adapters 126 of multiple sized can be substituted depending on the size of the primers being loaded into the primer tube. FIG. 4 illustrates an automated filler with interchangeable insert guides 122 and 162, interchangeable output guides 124 and 164 and interchangeable output adapters 126 and 166. For example, for smaller primers, insert guide 122, output guide 124 and output adapter 126 define channels 122*c*, 124*a*, and 126*a* with a diameter large enough to accommodate primers having an outer diameter of 4.43-4.48 mm. Additionally, for small primers, the height of exit lid 123 is adjusted to accommodate primers with a height of 2.92-3.20 mm. For larger primers, insert guide 162, output guide 164 and output adapter 166 define channels 122*c*, 124*a*, and 126*a* with a diameter large enough to accommodate primers measuring 5.33-5.38 mm in diameter. Additionally, for large primers, the height of exit lid 123 is adjusted to accommodate primers having a height range of 2.92-3.40 mm. The design of the primer loading subassembly is such that the insert guides 122, 162, output guides 124, 164 and output adapters 126, 166 can easily be removed and replaced as needed.

Preferably, situated around the upper feed assembly is an optional cover 220 that also preferably includes an opening 222 for accessing the primer loading subassembly 120 and an opening 224 for accessing the power connector 160. Cover 220 preferably is transparent and further removably connects to base 110, preferably clicking into place with a bayonet type connection that allows for swift removal and installation. When present, cover 220 operates as a safety shield to protect a user should a primer detonate. Removably connected to and situated atop cover 220 is an optional receiving lid 230. Receiving lid 230 defines an opening 232 at its center, is generally shaped with a concave surface that acts like a funnel, and is optionally transparent. When positioned atop cover 220, it funnels any primers poured into it to bowl 130, which is situated immediately below. Preferably opening 232 is positioned directly above cone 138 of bowl 130.

To use the automated primer tube filler 10, a user first places an empty primer tube 5 preferably one with an optional magnetic adapter 7 in a position to cooperate with the primer loading subassembly by inserting it into the primer tube receiver channel 116*a* of base 110 through slot 116*c* preferably so magnetic adapter 7 is held to primer tube receiver 116 by metal ring 128. The user also places the appropriately sized exit insert 122, 162 in the bowl exit 140 and then places the appropriately sized output guide 124, 164 and output adapter 126, 166 into exit insert 122, 162 and primer tube receiver 116 of base 110 according to the size of primer that will be loaded into primer tube 5. The user further adjusts the height of exit lid 123 according to the size of the primers being loaded. After setting up the primer loading subassembly 120, the user activates the electromagnet 156, optionally adjusts the vibration frequency and automatic timer with controller 158 if present, and pours primers into the receiving lid 230. The primers then funnel into bowl 130 through opening 232, where they are vibrated toward the bowl's ramp 134. The primers move along ramp 134, which rejects improperly oriented primers via primer reject arm 144 or ramp notches 135. Properly oriented primers continue along ramp 134 until they reach the bowl opening 14*a* and opening 122*a* of exit insert 122. Exit lid 123 prevents primers from turning on their side as they fall into exit channel 122*c* and fall through tube 124 and adapter 126. The primers then fall into the primer tube 5. When the primer tube is full, it can be removed and replaced by an empty one. The fully loaded primer tube is then ready to used for reloading ammunition.

While in the foregoing, embodiments of the present invention have been set forth in considerable detail for the purposes of making a complete disclosure of the invention, it may be apparent to those of skill in the art that many changes may be made in such detail without departing from the spirit and principles of the invention.

I claim:

1. An automatic primer filler for reloading a primer tube with a plurality of primers having a recessed anvil surface, a flat surface, and an outer edge, the automatic primer filler comprising:

a) a stand assembly;

b) an upper feed assembly comprising:

i) a base attached to the stand assembly, the base comprising a primer tube receiver defining a primer tube receiver channel configured to removably hold a receiving end of the primer tube;

ii) a bowl positioned at a spaced distance above the base and stand assembly, the bowl comprising a central cavity and a bowl exit, wherein the bowl exit defines an exit channel in fluid communication with the central cavity of the bowl;

iii) a vibration subassembly comprising:

(a) a plurality of leaf springs, wherein each leaf spring comprises a first end attached to the base and a second end attached to the bowl;

(b) an electromagnet at least partially supported by the base, wherein the electromagnet is configured to couple to a power source; and (c) a metal plate attached to the bowl such that it sits at a spaced distance from the electromagnet;

iv) a primer loading subassembly comprising:

(a) a first exit insert defining an insert channel extending from an upper end of the first exit insert to a lower end of the first exit insert and an insert opening positioned near the upper end of the first exit insert, wherein the first exit insert removably attaches at least partly within the exit channel of the bowl, the insert opening of the first exit insert is in fluid communication with the bowl cavity, and the insert channel of the first exit insert is in fluid communication with the insert opening of the first exit insert;

(b) a first output adapter defining an adapter channel extending from an upper end of the first output adapter to a lower end of the first output adapter, wherein the first output adapter removably attaches at least partly within the primer tube receiver channel of the base such that the adapter channel of the first output adapter is in fluid communication with the receiving end of the primer tube when present;

(c) a first output guide defining a guide channel extending from an upper end of the first output guide to a lower end of the first output guide, wherein the upper end of the first output guide removably attaches to the lower end of the first exit insert, wherein the lower end of the first output guide removably attaches to the upper end of the first output adapter, and the guide channel of the first output guide is in fluid communication with the insert channel of the first exit insert and the adapter channel of the first output adapter when the first output guide is removably attached to the first output adapter and first exit insert; and (d) an exit lid removably attached to bowl, wherein at least part of the exit lid covers the bowl exit and exit channel of the bowl.

2. The automatic primer filler of claim 1 wherein the first output guide of the primer loading subassembly of the upper feed assembly comprises a spring.

3. The automatic primer filler of claim 1 wherein the primer loading subassembly of the upper feed assembly further comprises:

a) a second exit insert interchangeable with the first exit insert, the second exit insert defining an insert channel extending from an upper end of the second exit insert to a lower end of the second exit insert and an insert opening positioned near the upper end of the second exit insert, wherein the second exit insert removably attaches at least partly within the exit channel of the bowl, the insert opening of the second exit insert is in fluid communication with the bowl cavity, and the insert channel of the second exit insert is in fluid communication with the insert opening of the second exit insert;

b) a second output adapter interchangeable with the first output adapter, the second output adapter defining an adapter channel extending from an upper end of the second output adapter to a lower end of the second output adapter, wherein the second output adapter removably attaches at least partly within the primer tube receiver channel of the base such that the adapter channel of the second insert is in fluid communication with the receiving end of the primer tube when present; and c) a second output guide interchangeable with the first output guide, the second output guide defining a guide channel extending from an upper end of the second output guide to a lower end of the second output guide, wherein the upper end of the second output guide removably attaches to the lower end of the second exit insert, wherein the lower end of the second output guide removably attaches to the upper end of the second output adapter, and the guide channel of the second output guide is in fluid communication with the insert channel of the second exit insert and the adapter channel of the second output adapter when the second output guide is removably attached to the second output adapter and second exit insert;

wherein the first exit insert, first output guide, and first output adapter are configured to accept primers of a first size and the second exit insert, second output guide, and second output adapter are configured to accept primers of a second size.

4. The automatic primer filler of claim 3 wherein the first output guide of the primer loading subassembly of the upper feed assembly comprises a spring.

5. The automatic primer filler of claim 4 wherein the second output guide of the primer loading assembly of the upper feed assembly comprises a spring.

6. The automatic primer filler of claim 3 wherein the exit lid is height adjustable.

7. The automatic primer filler of claim 6 wherein the bowl further comprises a primer loading anchor defining a recess on an upper surface, wherein the primer loading anchor is integrally formed with the bowl exit, the exit lid of the primer loading subassembly removably secures to the primer loading anchor upper surface, and the recess of the primer loading anchor houses a resilient member.

8. The automatic primer filler of claim 7 wherein the recess defined by the primer loading anchor is an annular channel and the resilient member housed therein is an O-ring.

9. The automatic primer filler of claim 6 wherein the exit lid pivotally attaches to the primer loading anchor of the bowl such that the exit lid pivots between an open position exposing the bowl exit and exit channel of the bowl and a closed position wherein at least part of the exit lid covers the bowl exit and exit channel of the bowl.

10. The automatic primer filler of claim 1 wherein the primer tube assembly further comprises a metal ring disposed within the primer tube receiving channel of the base.

11. The automatic primer filler of claim 10 further comprising a primer tube magnetic adapter that removably attaches near the receiving end of a primer tube and magnetically cooperates with the metal ring disposed within the primer tube receiving channel of the base.

12. The automatic primer filler of claim 1 wherein the exit lid is height adjustable.

13. The automatic primer filler of claim 12 wherein the exit lid further pivotally attaches to the bowl such that it pivots between an open position exposing the bowl exit and exit channel of the bowl and a closed position wherein at least part of the exit lid covers the bowl exit and exit channel of the bowl.

14. The automatic primer filler of claim 1 wherein the bowl of the upper feed assembly further comprises:

a) a continuous bowl wall integrally connected around the perimeter of a bowl floor, wherein the bowl wall and bowl floor define the bowl cavity; and b) a ramp disposed in the bowl cavity and along the bowl wall, wherein the ramp extends from the bowl floor to the bowl exit.

15. The automatic primer filler of claim 14 wherein the ramp of the bowl of the upper feed assembly defines a plurality of notches configured to receive any primers oriented with their anvil surface facing the ramp and return them to the bowl floor.

16. The automatic primer filler of claim 14 wherein the bowl of the upper feed assembly further comprises a primer reject arm fixedly attached to the wall and positioned such that it extends into the bowl cavity above the ramp at a height relative to the ramp that allows primers oriented with their anvil or flat surface facing the ramp to pass underneath the primer reject arm while deflecting any primers oriented with their outer edge resting on the ramp.

17. The automatic primer filler of claim 1 further comprising:

a) a cover configured to fit around the perimeter of the upper feed assembly, the cover defining a first opening providing access to the primer tube receiver of the base; and b) a receiving top attached to the cover at a spaced distance above the bowl of the upper feed assembly, the receiving top defining a central opening disposed to funnel primers received by the receiving top into the bowl below.

18. An automatic primer filler for reloading a primer tube with a plurality of primers having a recessed anvil surface, a flat surface, and an outer edge, the automatic primer filler comprising:

a) a stand assembly;

b) an upper feed assembly comprising:

i) a base attached to the stand assembly, the base comprising a primer tube receiver defining a primer tube receiver channel configured to removably hold a receiving end of the primer tube;

ii) a bowl positioned at a spaced distance above the base and stand assembly, the bowl comprising:

(a) a continuous bowl wall integrally connected to and around the perimeter of a bowl floor, wherein the bowl wall and bowl floor define a central bowl cavity;

(b) a bowl exit integrally formed with the bowl wall, wherein bowl exit defines an exit channel in fluid communication with the central cavity of the bowl;

(c) a ramp disposed in the bowl cavity and along the bowl wall, wherein the ramp extends from the bowl floor to the bowl exit and defines a plurality of notches configured to deflect any primers oriented with their anvil surface facing the ramp; and (d) a primer reject arm fixedly attached to the bowl wall and positioned such that it extends into the central cavity of the bowl above the ramp at a height relative to the ramp that allows primers oriented with their anvil or flat surface facing the ramp to pass underneath the primer reject arm while deflecting any primers oriented with their outer edge resting on the ramp;

iii) a vibration subassembly comprising:

(a) a plurality of leaf springs, wherein each leaf spring comprises a first end attached to the base and a second end attached to the bowl;

(b) an electromagnet at least partially supported by the base, wherein the electromagnet is configured to couple to a power source; and (c) a metal plate attached to the bowl such that it sits at a spaced distance from the electromagnet;

iv) a primer loading subassembly comprising:

(a) a first exit insert defining an insert channel extending from an upper end of the first exit insert to a lower end of the first exit insert and an insert opening positioned near the upper end of the first exit insert, wherein the first exit insert removably attaches at least partly within the exit channel of the bowl, the insert opening of the first exit insert is in fluid communication with the bowl cavity, and the insert channel of the first exit insert is in fluid communication with the insert opening of the first exit insert;

(b) a first output adapter defining an adapter channel extending from an upper end of the first output adapter to a lower end of the first output adapter, wherein the first output adapter removably attaches at least partly within the primer tube receiver channel of the base such that the adapter channel of the first output adapter is in fluid communication with the receiving end of the primer tube when present; and (c) a first output guide comprising a spring and defining a guide channel extending from an upper end of the first output guide to a lower end of the first output guide, wherein the upper end of the first output guide removably attaches to the lower end of the first exit insert, wherein the lower end of the first output guide removably attaches to the upper end of the first output adapter, and the guide channel of the first output guide is in fluid communication with the insert channel of the first exit insert and the adapter channel of the first output adapter when the first output guide is removably attached to the first output adapter and first exit insert; and (d) a height-adjustable exit lid removably and pivotally attached to bowl, wherein the exit lid pivots between an open position exposing the bowl exit and exit channel of the bowl and a closed position wherein at least part of the exit lid covers the bowl exit and exit channel of the bowl;

c) a cover configured to fit around the perimeter of the upper feed assembly, the cover defining a first opening providing access to the primer tube receiver of the base; and d) a receiving top attached to the cover at a spaced distance above the bowl of the upper feed assembly, the receiving top defining a central opening disposed to funnel primers received by the receiving top into the bowl below.

19. The automatic primer filler of claim 18 wherein the primer loading subassembly of the upper feed assembly further comprises:

a) a second exit insert that can replace the first exit insert, the second exit insert defining an insert channel extending from an upper end of the second exit insert to a lower end of the second exit insert and an insert opening positioned near the upper end of the second exit insert, wherein the second exit insert removably attaches at least partly within the exit channel of the bowl, the insert opening of the second exit insert is in fluid communication with the bowl cavity, and the insert channel of the second exit insert is in fluid communication with the insert opening of the second exit insert;

b) a second output adapter that can replace the first output adapter, the second output adapter defining an adapter channel extending from an upper end of the second output adapter to a lower end of the second output adapter, wherein the second output adapter removably attaches at least partly within the primer tube receiver channel of the base such that the adapter channel of the second insert is in fluid communication with the receiving end of the primer tube when present; and c) a second output guide that can replace the first output guide, the second output guide comprising a spring and defining a guide channel extending from an upper end of the second output guide to a lower end of the second output guide, wherein the upper end of the second output guide removably attaches to the lower end of the second exit insert, wherein the lower end of the second output guide removably attaches to the upper end of the second output adapter, and the guide channel of the second output guide is in fluid communication with the insert channel of the second exit insert and the adapter channel of the second output adapter when the second output guide is removably attached to the second output adapter and second exit insert;

wherein the first exit insert, first output guide, and first output adapter are configured to accept primers of a first size and the second exit insert, second output guide, and second output adapter are configured to accept primers of a second size.

20. The automatic primer filler of claim 19 further comprising:

a) a metal ring disposed within the primer tube receiving channel of the base; and b) a primer tube magnetic adapter that removably attaches near the receiving end of a primer tube and magnetically cooperates with the metal ring disposed within the primer tube receiving channel of the base.

* * * * *